US005795843A

United States Patent [19]

Endo

[11] Patent Number: 5,795,843

[45] Date of Patent: *Aug. 18, 1998

[54] PITCH-BASED ACTIVATED CARBON FIBER

[75] Inventor: Morinobu Endo, Suzaka, Japan

[73] Assignee: Petoca, Ltd., Tokyo, Japan

[ * ] Notice: The term of this patent shall not extend beyond the expiration date of Pat. No. 5,446,005.

[21] Appl. No.: 385,378

[22] Filed: Feb. 7, 1995

Related U.S. Application Data

[63] Continuation of Ser. No. 205,345, Mar. 3, 1994, abandoned, which is a continuation of Ser. No. 899,901, Jun. 17, 1992, abandoned.

[30] Foreign Application Priority Data

Jun. 19, 1991 [JP] Japan ..... 3-173293

[51] Int. Cl.[6] ..... B01J 20/02

[52] U.S. Cl. ..... 502/416; 423/447.2

[58] Field of Search ..... 502/416, 433; 423/447.2

[56] References Cited

U.S. PATENT DOCUMENTS

| | | | |
|---|---|---|---|
| Re. 29,101 | 1/1977 | Amagi et al. | 423/445 |
| 4,734,394 | 3/1988 | Kosaka et al. | 423/447.6 |
| 5,047,292 | 9/1991 | Sadanobu et al. | 423/447.2 |
| 5,446,005 | 8/1995 | Endo | 423/447.2 |

FOREIGN PATENT DOCUMENTS

| | | | |
|---|---|---|---|
| 0 016 661 | 10/1980 | European Pat. Off. . | |
| 0 366 539 | 5/1990 | European Pat. Off. . | |
| 0 439 005 | 7/1991 | European Pat. Off. . | |
| 2 349 163 | 4/1974 | Germany . | |
| 3 406 654 | 8/1985 | Germany . | |
| 62-152534 | 7/1987 | Japan | 502/416 |

OTHER PUBLICATIONS

Chemical Abstracts, AN 140500v, vol. 106, No. 18, May 1987, p. 127, & JP-A-61 295 218, Dec. 26, 1986, N. Shinto, et al., "Fibrous Activated Carbon".

Journal of Materials Science vol. 23 (1988) 598–605, Morinobu Endo.

*Primary Examiner*—Michael Lewis

*Assistant Examiner*—Stuart L. Hendrickson

*Attorney, Agent, or Firm*—Oblon, Spivak, McClelland, Maier & Neustadt, P.C.

[57] ABSTRACT

There is provided an optically isotropic pitch-based activated carbon fiber which comprises having a large number of pores each with a radius of 0.15 to 2.5 nm and having a specific surface area of 500 $m^2/g$ or more, the pores being distributed uniformly in both the surface layer part and the inner part of the fiber and allowed to three-dimensionally communicate with each other at least partially.

The above activated carbon fiber is prepared by adjusting the size and density of the pores in the fiber by controlling the conditions for preparing the optically isotropic pitch, spinning the pitch and/or activation of the infusibilized or carbonized pitch-based fiber.

The activated carbon fiber thus obtained is enhanced in adsorption efficiency without decrease in mechanical strength thereof and is widely used for a variety products in accordance with the kind of the substances to be adsorbed.

2 Claims, 3 Drawing Sheets

PITCH-BASED ACTIVATED CARBON FIBER

This application is a Continuation of application Ser. No. 08/205,345, filed on Mar. 3, 1994, now abandoned; which is a Continuation of application Ser. No. 07/899,901, filed on Jun. 17 1992, now abandoned.

BACKGROUND OF THE INVENTION

1. Field of the Invention

The present invention relates to a novel activated carbon fiber. More particularly, it relates to a novel optically isotropic pitch-based activated carbon fiber in which a large number of pores are distributed with a substantially uniform density (the number of pores per unit volume of the fiber) and allowed to three-dimensionally communicate with each other at least partially.

The present invention further provides a novel optically isotropic pitch-based activated carbon fiber in which the radius and/or the density of the pores are adjusted through the condition of spinning and/or the condition of activation of infusibilized or carbonized pitch-based fiber and which, by the effect of the adjusted structure, selectively exhibits a high adsorption efficiency according to various applications.

2. Description of the Related Arts

Particulate activated charcoals and activated carbon fibers have heretofore been known as materials having the property of adsorption and desorption of various substances and ions. Particularly, activated carbon fibers are in the form of fiber and widely used, with or without additional treatment such as shaping, as materials for adsorbing applications, such as adsorbent, water purifiers, deodorant, deodorizing filters and the like, catalyst carriers and applications making use of intercalation potential of ions to carbon such as batteries, capacitors, condensers and the like.

A large number of pores are found in the particulate activated charcoals and in the activated carbon fibers. Size and density and/or distribution of the pores as well as structure of the pores are considered to be significant factors for fully exhibiting the adsorption and desorption functions of the particulate activated charcoals or activated carbon fibers.

However, adjustment of the radius, the density and the distribution of the pores is extremely difficult because they are varied depending on raw pitch materials and production conditions. Japanese Patent Application Laid-Open No. 295218/1986 describes a trial for controlling the distribution of the pores in an optically isotropic pitch-based activated carbon fiber according to the purpose of applications. However, nothing is known of the conventional particulate activated charcoals or activated carbon fibers in which the distribution of the pores in the inner part of the fiber is controlled, for example, to achieve a uniform distribution of the pores.

When an activated carbon fiber has pores distributed uniformly not only in the surface layer part but also in the inner part of the fiber, the number of the pores in the unit volume of the fiber is increased and the efficiency of the adsorption by the fiber is enhanced. The fiber having such a structure is expected to find a still wider range of applications.

However, hitherto none of the conventional particulate activated charcoals and activated carbon fibers has not sufficiently met the above-mentioned requirement regardless of the origin such as pitch-based materials or organic materials, including rayon-based, polyacrylonitrile-based, phenol resin-based and the other materials.

The pores can be classified into a macropore having a radius of 25 nm or larger, mesopore having a radius in the range of 1 to 25 nm and micropore having a radius of 1 nm or smaller. The pores of the conventional particulate activated charcoals and activated carbon fibers are non-uniformly distributed and the pore structure is roughly classified into a structure in which macropores are in the surface layer part of the fiber, mesopores are in the inner part thereof and micropores are in the further inner part thereof, and a structure in which mesopores are in the surface layer part of the fiber and micropores are in the inner part thereof (refer to, for example, Kobunshi Kako, Volume 35, Number 8, pages 20 to 21, 1986).

It is generally believed that micropores are the most effective for the adsorption. In the conventional materials, the micropores are developed straight forward and are distributed mainly in the part close to the surface of the material and the radius thereof reduces monotonously with the distance from the surface. To attain higher adsorption efficiency in this kind of structure, the number of pores in the surface layer must be increased resulting in the problem that the strength of the material is inevitably deteriorated.

SUMMARY OF THE INVENTION

An object of the present invention is to provide an activated carbon fiber having the structure in which a large number of pores are distributed with a uniform density in the surface layer part and also in the inner part of the fiber and allowed to three-dimensionally communicate with each other at least partially.

In the course of study to accomplish the above object, the present inventors have found that the object described above can be attained by adjusting the radius and/or the density of the pores of the activated carbon fiber by controlling the preparation conditions of optically isotropic pitch, the spinning conditions of the pitch-based fiber and/or the conditions of activation treatment of the infusibilized or carbonized pitch-based fiber.

The present invention provides an optically isotropic pitch-based activated carbon fiber which comprises having a large number of pores each with a radius substantially in the range of 0.15 to 2.5 nm and having a specific surface area of 500 $m^2/g$ or more, said pores being distributed with a substantially uniform density in the surface layer part and also in the inner part of the fiber and being allowed to three-dimensionally communicate with each other at least partially.

The present invention also provides an optically isotropic pitch-based activated carbon fiber as described above wherein the pores form a fractal structure of a dimension in the range of 2.1 to 2.9.

Other and further objects, features and advantages of the invention will appear more fully in the following description.

DESCRIPTION OF PREFERRED EMBODIMENTS

The optically isotropic pitch-based activated carbon fiber of the present invention will be described in detail in the following.

(The optically isotropic pitch-based activated carbon fiber)

The optically isotropic pitch-based activated carbon fiber of the present invention is an activated carbon fiber which comprises having a large number of pores each with a radius substantially in the range of 0.15 to 2.5 nm, having no macropore in the surface layer part of the fiber, and having mesopores and micropores randomly distributed in the surface layer part thereof and open directly to the surface.

Figure 1:
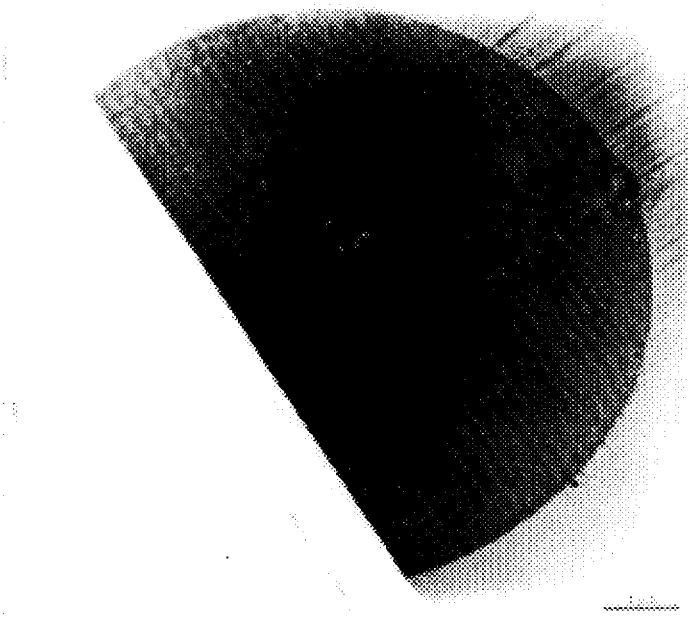
FIG. 1 is a micrograph of the cross section of the activated carbon fiber of the present invention taken with a transmission electron microscope.

FIG. 1 is a micrograph of a cross section of the activated carbon fiber of the present invention having a diameter of about 8 μm taken with a transmission electron microscope. No irregularity caused by macropores is observed in the outer periphery of the cross section of the fiber.

Figure 2:
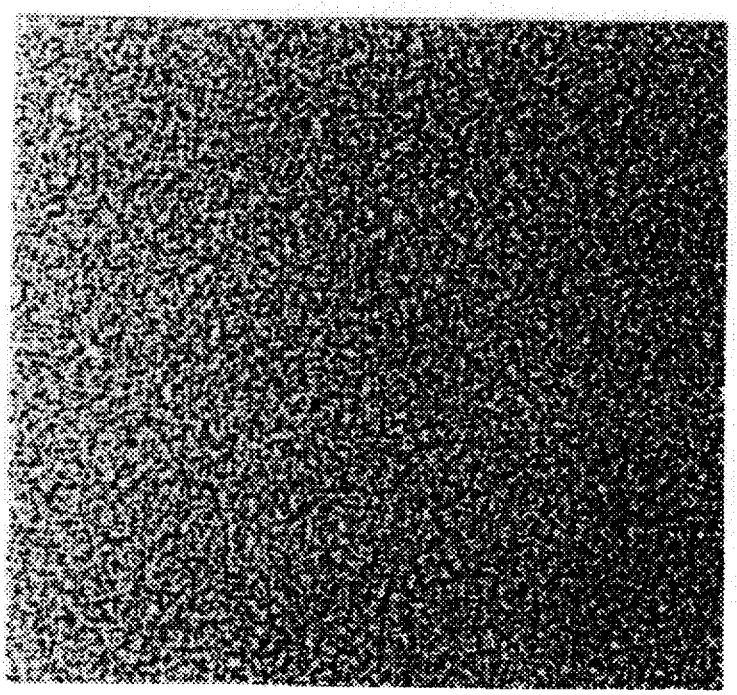
FIG. 2 is a micrograph of the cross section of the inner part (the central part) of the activated carbon fiber of the present invention taken with a transmission electron microscope at a magnification of about 750,000.
Figure 3:
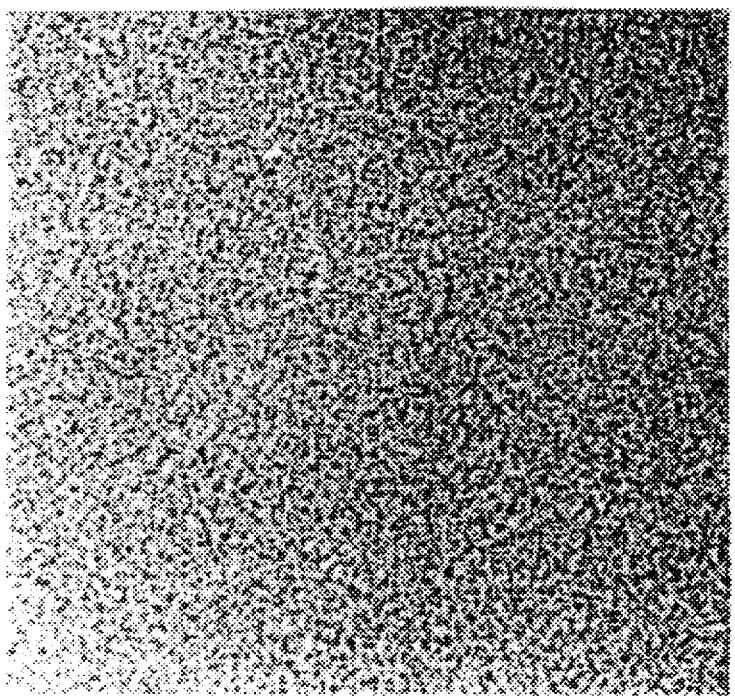
FIG. 3 is a micrograph of the cross section of the surface layer part of the activated carbon fiber of the present invention taken with a transmission electron microscope at a magnification of about 750,000.

FIG. 2 is a micrograph of a cross section of the inner part (the central part) of the activated carbon fiber of the present invention and FIG. 3 is a micrograph of a cross section of the surface layer part of the activated carbon fiber of the present invention both taken with a transmission electron microscope. White dots in the micrographs show pores in the fiber. The density and the radius of the pores are determined based on these micrographs. It can be seen that the difference between the density of the pores in the surface layer part and the density of the pores in the inner part (the central part) is within 5% and that the pore radii are almost less than 2.5 nm. As the pores of the activated carbon fiber of this invention are developed with similar figures in the surface layer part and also in the inner part of the fiber, the structure of the pores may be a so-called fractal structure which is a quite different structure from above-mentioned common structures of the pores.

When the structure of the pores of the activated carbon fiber of the present invention was examined by fractal analysis, the fractal dimension was found to vary depending on the specific surface area, etc. and lie in the range of 2.1 to 2.9. The fractal analysis was performed according to the ordinary method by varying the degree of roughness of view (the scale). Specifically, the fractal dimension was obtained by a method wherein a pattern obtained by the image treatment of a micrograph taken with a transmission electron microscope was divided into a large number of squares, the length of the side of the squares was varied, the number of the squares that were completely included within the pore area was counted, and the degree of the change in the number of the squares with the change in the length of the side thereof was numerized.

A larger value of a fractal dimension shows that the pattern is more complicated and has a higher degree of multi-dimension. The fractal dimension of the pore structure of the activated carbon fiber in the present invention is in the range of 2.1 to 2.9 and the pores are observed to be distributed not only in the surface layer part but also in the inner part by the micrographs of the cross section of the fiber taken with a transmission electron microscope, showing that the pores are allowed to three-dimensionally communicate with each other extending not straight forward.

It is most desirable for enhancing the adsorption efficiency that a pore communicates with all the pores surrounding it. However, when a pore communicates with at least a part of the surrounding pores, the adsorption efficiency is enhanced and the function of the activated carbon fiber as the adsorbing material can be favorably exhibited.

According to the present invention, the density and the size of pores of the activated carbon fiber are controlled by the conditions of activation, and it is possible to produce the fiber having a pore radius in the range of 0.15 to 2.5 nm and a BET specific surface area of the fiber of at least 500 $m^2/g$ or even in the range of 2,500 to 3,500 $m^2/g$ depending on the production conditions.

The activated carbon fiber of the present invention has a higher mechanical strength and the advantage of suffering less damage during handling even when the adsorption efficiency is enhanced as compared with conventional activated carbon fibers. When the fractal dimension of the pore structure is more than 2.9, the damage suffered during handling tends to increase remarkably presumably because of the decreased mechanical strength of the fiber. On the other hand, when the fractal dimension is less than 2.1 and the specific surface area is less than 500 $m^2/g$, the adsorption efficiency is decreased.

A process for preparing the optically isotropic pitch-based carbon fiber of the present invention will be described in the following, for example.

(Preparation of optically isotropic pitch)

Optically isotropic pitch is utilized as a pitch material for spinning in the preparation of the activated carbon fiber of the present invention because the activation thereof can be made with ease.

The kind of raw pitch material utilized for preparing the optically isotropic pitch is not particularly limited so long as the pitch material gives optically isotropic pitch of a high softening point by a treatment such as the heat treatment under blowing with an oxygen-containing gas. Examples of the raw pitch material utilized for the preparation of the optically isotropic pitch include materials prepared from residual oil of crude oil distillation, residual oil of naphtha cracking, ethylene bottom oil, liquefied coal oil, coal tar and the like through treatments such as filtration, purification, distillation, hydrogenation and catalytic cracking.

The optically isotropic pitch can be prepared from the raw pitch material, for example, by the following process comprising the steps of (a), (b), (c) and (d):

(a) The raw pitch material is heat treated under the blowing with an inert gas such as a nitrogen at a temperature in the range of 350° to 450° C. to produce a heat treated pitch material containing about 5% by weight of optically anisotropic components. Then the optically anisotropic components are separated and removed from the heat treated pitch material.

(b) The resultant pitch material is heat treated under a blown an oxygen-containing gas at a temperature in the range of 150° to 400° C., preferably 300° to 380° C. As the oxygen-containing gas, air or an oxygen-rich gas is utilized, but air is preferable because it is readily available. Blowing with nitrogen etc. is unfavorable since it increases the content of optically anisotropic components in the product.

The amount of oxygen required for the heat treatment is generally in the range of 0.2 to 5 NL/minute per 1 kg of the pitch. A heat treatment temperature lower than 150° C. is unfavorable since it lowers the reactivity, whereas a temperature higher than 400° C. is also unfavorable because the control of the reaction is made difficult and the pitch having the desired high softening point is unlikely to be prepared.

The pitch prepared by the heat treatment under the condition described above has a softening point as measured by the Metler method or by the Ring and Ball (R. B.) method in the range of 150° to 300° C., preferably 200° to 250° C. and contains quinoline-insoluble components in the range of several to 15% by weight;

(c) The above heat treated pitch is filtered by using a disc filter, such as a DIPS filter of 0.3 to 3 μm, at a temperature higher than the softening point of the pitch by about 50° C. to remove the quinoline-insoluble components substantially completely.

The method of removing the quinoline-insoluble components is not particularly limited to the method described above but any other method which can remove the quinoline-insoluble components without affecting the quality of the pitch may be utilized including the methods such as separation by the difference in specific gravity and centrifugal separation; and (d) The above-obtained pitch from which the quinoline-insoluble components have been removed is heat treated at a high temperature under a reduced pressure of blown gas. The heat treatment is stopped before optically anisotropic components are formed to produce the optically isotropic pitch.

The aforesaid heat treatment under a reduced pressure is effected by the use of a gas similar to that in the step (b) at a pressure in the range of 5 to 15 Torr (666 to 2000 Pa) and an elevated temperature in the range of 300° to 350° C. for 20 minutes to 1 hour, thus affording the pitch having a softening point in the range of 250° to 290° C. and substantially free from quinoline-insoluble components.

The homogeneous and optically isotropic pitch having a high softening point and a narrow molecular weight distribution can be prepared by the series of the steps (a), (b), (c) and (d) as described above. As the pitch material for preparing the activated carbon fiber of the present invention, the isotropic pitch material prepared through the series of the steps as described above is preferred.

(Spinning of the optically isotropic pitch)

As the method for spinning the optically isotropic pitch of the present invention, conventional melt spinning methods can be utilized. In order to obtain a material like a nonwoven fabric, the spinning method generally called the melt blow method in which the optically isotropic pitch is spun from spinning nozzles placed in a slit where a high speed stream of gas is injected is preferable because of the higher production efficiency.

It is preferable for maintaining uniformity of the optically isotropic pitch fiber that the temperature of the spinneret be held higher than the softening point of the pitch by 20° to 80° C. and that the temperature of the gas stream be held higher than the temperature of the spinneret by 10° to 50° C. Under this condition, the temperature of the spun pitch is estimated to be somewhat lower than the temperature of the spinneret.

When the softening point of the optically isotropic pitch to be spun is lower than 200° C., a longer time is required for infusibilizing the spun fiber and the productivity thereof is extremely reduced. When the softening point thereof is higher than 300° C., a considerably higher temperature is required for the spinning and the quality of the pitch is deteriorated to cause decrease in the strength of the spun fiber.

Viscosity of the pitch in the spinning in the invention is higher than the viscosity in the conventional melt blow method and in the range of 10 to 200 poise, preferably 30 to 100 poise.

The temperature of the spinneret, the temperature of gas and the injection speed of gas vary depending on the viscosity and the softening point of the optically isotropic pitch, physical properties of the finally prepared activated carbon fiber and the like other factors and can not be unequivocally determined. In general practice, however, it is preferable that the temperature of the spinneret be in the range of 290° to 360° C., the temperature of gas be in the range of 300° to 380° C. and the speed of injected gas be in the range of 200 to 350 m/second.

When the temperature of the spinneret is lower than 290° C., the resultant excessively high viscosity of the pitch causes unstable spinning and decrease in the strength of the prepared fiber. The temperature thereof higher than 360° C. is unfavorable since so-called shot takes place more frequently.

(Infusibilizing treatment of the optically isotropic pitch fiber)

The infusibilizing treatment of the optically isotropic pitch fiber can be conducted according to a conventional method. For example, the treatment can be made by oxidation at a temperature raising rate in the range of 0.2° to 20° C./minute at temperatures from 150° to 400° C., preferably from 180° to 320° C. The treatment can be conducted in an atmosphere such as oxygen-rich gas or air. The atmosphere may partially contain chlorine gas or nitrogen oxide gas.

(Activation of the infusibilized pitch-based fiber with or without preceding moderate carbonization)

The infusibilized pitch-based fiber thus obtained can be made into the activated carbon fiber by the direct activation or the moderate carbonization followed by activation.

The moderate carbonization is conducted by carbonization according to a conventional method, for example, at a temperature of 1000° C. or lower, preferably 800° C. or lower, and at a temperature raising rate in the range of 5° to 100° C./minute in an inert gas such as nitrogen. Activation of fabricated fibers, such as felt and woven fabrics, is made possible by having the moderate carbonization before the activation treatment.

The activation treatment is conducted according to a conventional method generally at 800° to 1500° C. for several minutes to 2 hours in an atmosphere such as air, steam or carbon dioxide. The type of usable activation apparatus is not particularly limited but is exemplified by an activation furnace of vertical or horizontal type and an activation furnace of batch or continuous type.

The size and the density of pores of the activated carbon fiber can be adjusted by controlling the activation conditions. The activation at a higher temperature for a shorter time produces an activated carbon fiber having uniform density of pores with smaller and more uniform distribution of pore radius even when the specific surface area is kept constant. On the other hand, the activation at a lower temperature for a longer time produces an activated carbon fiber having pore radii distributed in a wider range.

When the temperature of activation is increased while the time of activation is held constant, the specific surface area tends to be increased and an activated carbon fiber having larger pore radii tends to be produced. When the time of activation is extended while the temperature of activation is held constant, the density of pores tends to be increased and pores having larger radii tend to be included.

The optically isotropic pitch-based carbon fiber having a wide range of pore radius and/or pore density can be prepared by controlling various conditions of the preparation while the pore density of the prepared fiber is kept uniform. Thus, the selective adsorption by the fiber can be extended to substances and conditions of a wider range and the fiber can be served for manufacturing a variety of products in accordance with the kind of the substances to be adsorbed and with the requirements of applications.

The optically isotropic pitch-based activated carbon fiber of the present invention is spun to the form of fiber and utilized with or without additional treatment such as shaping, as materials for adsorbing applications, such as gas phase and liquid phase adsorbent for trihalomethane, water purifiers, deodorant, deodorizng filters and the like, catalysts carriers and applications making use of intercalation potential of ions to carbon such as batteries, capacitors, condensers and the like.

In the present invention, the pitch fiber spun by using the homogeneous and optically isotropic pitch having a high softening point and by the high viscosity melt blow process or the like is preferred as the intermediate fiber served for the activation. The activated carbon fiber having the structure in which a large number of pores are distributed with a uniform density in both the surface layer part and the inner part of the fiber and allowed to three-dimensionally communicate with each other at least partially is prepared from the pitch fiber by controlling various preparation conditions such as the spinning temperature of the optically isotropic pitch. The reason for the above-mentioned advantage of the present invention is not fully elucidated, however it is presumed that the characterized preparation condition of the optically isotropic pitch as well as the melt blowing under high viscosity condition greatly accelerate the homogenization and refinement of the carbon layer in the pitch.

To summarize the advantages obtained by the present invention, the activated carbon fiber of the present invention has a high adsorption efficiency without decrease in mechanical strength because it has a structure in which a large number of pores are distributed with a uniform density in both the surface layer part and the inner part of the fiber and allowed to three-dimensionally communicate with each other at least partially.

In addition, the density and the size of pores can be adjusted in a wide range by controlling the preparation condition of the optically isotropic pitch, the spinning condition and the condition of activation of infusibilized or moderate carbonized pitch fiber and further, the fiber thus prepared can be served for manufacturing a variety of products in accordance with the kind of the substances to be adsorbed and with the requirements of applications.

The present invention will be described in more detail with reference to the following examples; however, these examples are intended to illustrate the invention and are not to be construed to limit the scope of the invention.

EXAMPLE 1

<Preparation of an optically isotropic pitch>

A heavy oil having an initial boiling point of 480° C., a final boiling point of 560° C. and a softening point of 72° C. which was prepared from a petroleum catalytic cracking heavy oil by filtration, removal of catalyst and distillation was used as the raw pitch material. The raw pitch material was heat treated under nitrogen blowing at 400° C. to produce a heat treated pitch material containing about 5% weight of optically anisotropic components. The heat treated pitch was settled at 330° C. to precipitate the optically anisotropic components. Then the lower part containing the optically anisotropic components was removed from the settled pitch. Into a 200 L (liter) reactor, 140 kg of the resultant pitch material was charged and heat treated at 370° C. for 5 hours under air blowing at a rate of 1.0 NL/kg.minute to obtain a pitch intermediate having a softening point of 250° C. and QI (the amount of the component insoluble in quinoline) of 7.5% by weight at a pitch yield of 63.1% by weight.

The pitch intermediate was filtered with a 0.5 μm disc filter at 300° C. to obtain a pitch having a softening point of 245° C. and QI of 1% by weight or less.

Into a 10 L (liter) reactor, 2.0 kg of the pitch thus obtained was charged and heat treated at 350° C. for 0.5 hour under vacuum of 5.0 Torr and under air blowing at a rate of 0.5 NL/kg.minute to obtain an optically isotropic pitch having a softening point of 280° C. and QI of 1% by weight or less at a pitch yield of 94% by weight.

The pitch thus obtained was observed with a polarized microscope and found to be free from optically anisotropic component.

<Preparation of a pitch-based activated carbon fiber>

The optically isotropic pitch thus obtained was spun by the use of a spinneret in which 1000 nozzle holes having a diameter of 0.2 mm were arranged in a row in a slit of 2 mm width to prepare a pitch fiber at a pitch delivery rate of 1,000 g/minute, a pitch temperature of 350° C., a heated air temperature of 380° C., and a air blow speed of 320 m/second.

The spun fiber was collected on a belt having a collecting part made of a 35 mesh stainless steel by sucking from the back of the belt.

The mat-like sheet of the pitch fiber thus obtained was infusibilized in air by raising the temperature thereof at a rate of 10° C./minute up to the maximum temperature of 310° C., followed by activatation at 1,000° C. for 10 minutes in an atmosphere containing 35% by weight of steam.

The activated carbon fiber was thus prepared in a yield of 20% by weight, and had an iodine adsorption of 2,565 mg/g, a benzene adsorption of 95.0% by weight, a methylene blue adsorption of 630 mg/g and a specific surface area of 2,500 $m^2/g$.

The micrographs of the activated carbon fiber taken with a transmission electron microscope in FIGS. 1, 2 and 3 show that the difference between the pore density in the surface layer part and the pore density in the inner part of the fiber was within 5%. The fractal dimension was found to be 2.6. It was also observed that the pores of various sizes coexisted randomly substantially within the range of about 0.2 to 2 nm in radius.

EXAMPLE 2

The mat-like sheet of the pitch fiber prepared in EXAMPLE 1 was infusibilized in air by raising the temperature thereof at a rate of 10° C./minute up to the maximum temperature of 310° C., followed by activatation at 900° C. for 15 minutes in an atmosphere containing 35% by weight of steam.

The activated carbon fiber was thus prepared in a yield of 60% by weight, and had an iodine adsorption of 1,229 mg/g, a benzene adsorption of 37.8% by weight, a methylene blue adsorption of 380 mg/g and a specific surface area of 1,200 $m^2/g$. The fractal dimension of the pore structure was 2.4. The proportion of pores of smaller radii in the fiber was found to be somewhat higher than in the fiber of EXAMPLE 1.

EXAMPLE 3

The mat-like sheet of the pitch fiber prepared in EXAMPLE 1 was infusibilized in air by raising the temperature thereof at a rate of 10° C./minute up to the maximum temperature of 310° C., and then moderate carbonized for 15 minutes in nitrogen by raising the temperature thereof at a rate of 10° C./minute up to the maximum temperature of 850° C.

The mat-like sheet of the moderate carbonized fiber was laminated and fabricated by needle punching to prepare a felt having a unit weight of 50 g/m$^2$, followed by activatation under the same condition as in EXAMPLE 2.

The activated carbon fiber felt thus prepared had almost the same characteristics as the activated carbon fiber prepared in EXAMPLE 2.

EXAMPLE 4

The activated carbon fiber prepared in EXAMPLE 1 was employed for the experiment of removing free chlorine in water. For the purpose of comparison, a conventional phenolic resin based activated carbon fiber having a specific surface area of 2,500 m$^2$/g was also subjected to the experiment under the same condition.

The experiment was conducted by charging 7.0 g of each of the above activated carbon fibers into a water purifier (Tiger AFD-0100 type, a product of Tiger Co., Ltd.).

In the above experiment, adjustments were made so as to attain a concentration of residual free chlorine in water of 2±0.2 ppm, an filtration rate through the activated carbon fiber of 1±0.1 L/min and a water temperature of 26° to 32° C.

The filtration capacity was calculated from the amount of the residual free chlorine measured after passing through the water purifier until the efficiency of dechlorination decreased as low as 90%, whereupon the filtrated volume was measured to determine the filtration capacity per unit weight of the activated carbon fiber.

Figure 4:
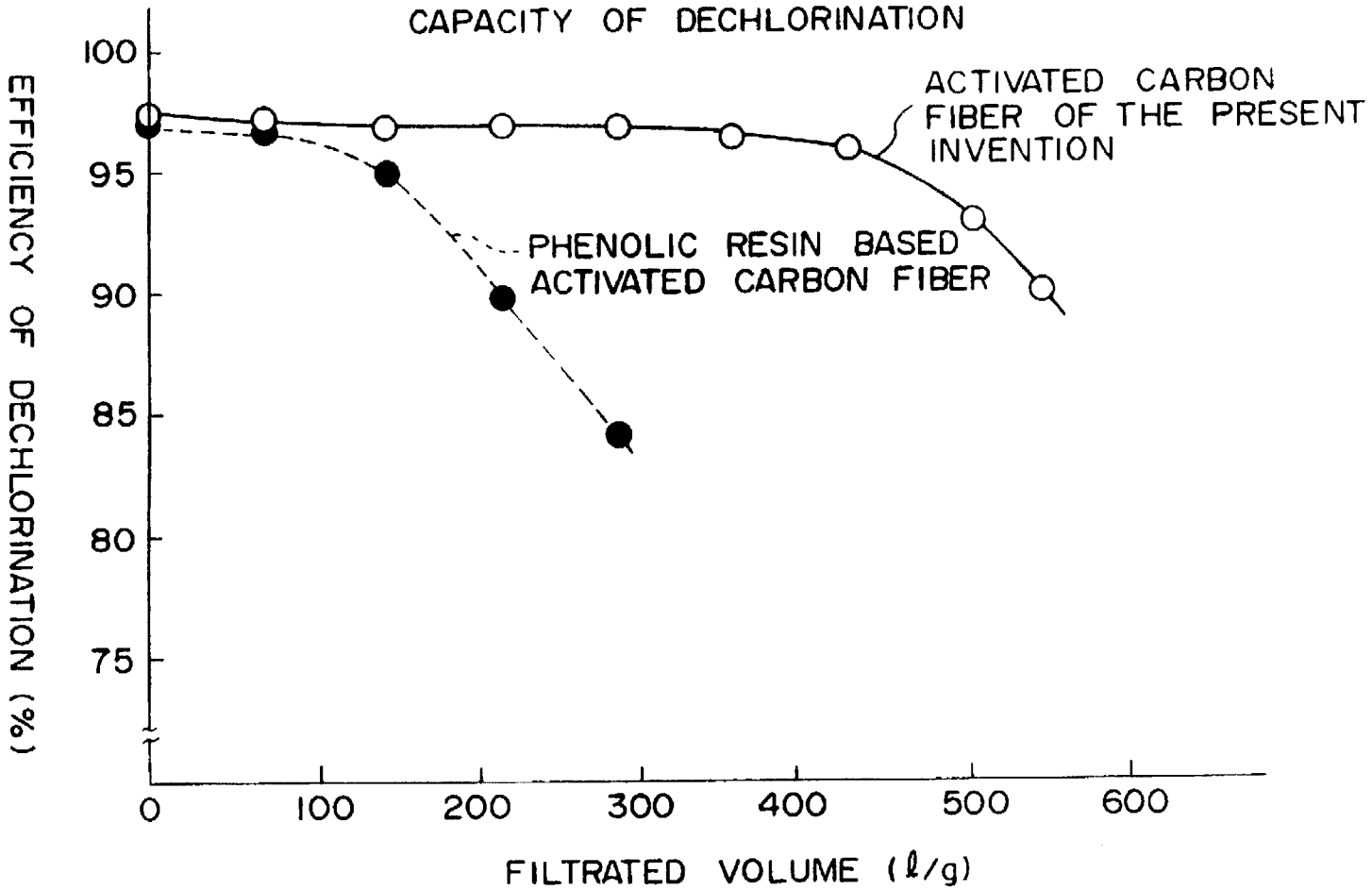
FIG. 4 is a figure showing the relationship between the efficiency of dechlorination and the filtrated volume when chlorine-containing water is filtered with the activated carbon fiber.

The relationship between the filtrated volume and the efficiency of dechlorination is shown in FIG. 4. As a result, the activated carbon fiber of the invention had an extremely excellent filtration capacity as high as about 550 L/g.

The conventional phenolic resin based activated carbon fiber revealed a filtration capacity of at most 200 L/g even though it had the same specific surface area as the activated carbon fiber of EXAMPLE 1. The aforesaid result clearly demonstrates the high adsorption efficiency characterizing the activated carbon fiber of the present invention.

While the present invention has been particularly shown and described with reference to preferred embodiments thereof, it will be understood by those skilled in the art that the foregoing and other modification in form and details can be made therein without departing from the spirit and scope of the present invention.

What is claimed is:

1. An optically isotropic pitch-based activated carbon fiber having pores with radii in the range of 0.15 to 2.5 nm, and having a specific surface area of at least 500 m$^2$/g and a fractal dimension of the pore structure obtained by a transmission electron microscope method in the range of 2.1 to 2.9.

2. An optically isotropic pitch-based activated carbon fiber having pores with radii in the range of 0.15 to 2.5 nm, and having a specific surface area of 500 m$^2$/g to 3,500 m$^2$/g and a fractal dimension of the pore structure obtained by a transmission electron microscope method in the range of 2.1 to 2.9.

* * * * *